US010797445B2

(12) United States Patent
Zhou et al.

(10) Patent No.: US 10,797,445 B2
(45) Date of Patent: Oct. 6, 2020

(54) ELECTRICAL CONNECTOR HAVING A CHAMFERED HOUSING STRUCTURE AND A UNITARY SHIELDING SHELL LATCH ALIGNED WITH THE CHAMFERED HOUSING STRUCTURE

(71) Applicant: FOXCONN INTERCONNECT TECHNOLOGY LIMITED, Grand Cayman (KY)

(72) Inventors: Zhi-Yong Zhou, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/386,258

(22) Filed: Apr. 17, 2019

(65) Prior Publication Data

US 2019/0319407 A1 Oct. 17, 2019

(30) Foreign Application Priority Data

Apr. 17, 2018 (CN) ..... 2018 1 0343528

(51) Int. Cl.

| | |
|---|---|
| ***H01R 13/6581*** | (2011.01) |
| ***H01R 13/405*** | (2006.01) |
| ***H01R 13/627*** | (2006.01) |
| ***H01R 24/60*** | (2011.01) |
| *H01R 107/00* | (2006.01) |

(52) U.S. Cl.

CPC ..... *H01R 13/6581* (2013.01); *H01R 13/405* (2013.01); *H01R 13/6271* (2013.01); *H01R 24/60* (2013.01); *H01R 2107/00* (2013.01)

(58) Field of Classification Search

CPC .. H01R 13/64; H01R 13/6581; H01R 13/405; H01R 13/6271

USPC ..... 439/677, 680

See application file for complete search history.

(56) References Cited

U.S. PATENT DOCUMENTS 7,186,150 B1 * 3/2007 Boone ..... H01R 12/727 439/680
7,192,297 B1 * 3/2007 Wu ..... H01R 12/592 439/358
7,628,638 B2 * 12/2009 Wu ..... H01R 9/032 439/358

(Continued)

*Primary Examiner* — Abdullah A Riyami
*Assistant Examiner* — Marcus E Harcum
(74) *Attorney, Agent, or Firm* — Wei Te Chung; Ming Chieh Chang

(57) ABSTRACT

An electrical connector includes: an insulative housing; plural conductive terminals disposed in the insulative housing; and a shield shell covering the insulative housing, wherein the shield shell has a mating frame opening at a front end thereof, the mating frame opening including a top edge, a bottom edge parallel to the top edge, a first side and a second side respectively perpendicular to a left and a right ends of the top edge, a first connecting edge connected between the first side and the bottom edge, and a second connecting edge connected between the second side and the bottom edge, the first connecting edge has a first angle with respect to the bottom edge, the second connecting edge has a second angle with respect to the bottom edge, and the first angle and the second angle are both obtuse angles.

9 Claims, 12 Drawing Sheets

(56) References Cited

U.S. PATENT DOCUMENTS 7,736,186 B2 * 6/2010 Li ..... H01R 13/627 439/607.55
7,892,027 B2 * 2/2011 Mao ..... H01R 12/712 439/607.25
8,100,709 B2 * 1/2012 Zhang ..... H01R 13/6275 439/353
8,485,839 B2 * 7/2013 Morgan ..... H01R 13/745 439/353
8,562,378 B2 * 10/2013 Su ..... H01R 13/6581 439/607.55
8,956,167 B2 * 2/2015 Wu ..... H01R 13/40 439/497
9,306,347 B2 * 4/2016 Ma ..... H01R 24/60
9,397,438 B2 * 7/2016 Chen ..... H01R 13/5202
9,397,442 B2 7/2016 Sutter et al.
9,431,781 B2 * 8/2016 Kuang ..... H01R 13/6586
9,461,429 B2 * 10/2016 Wu ..... H01R 13/6593
9,748,706 B2 * 8/2017 Lv ..... H01R 13/6658
2011/0280528 A1 * 11/2011 Wu ..... G02B 6/3817 385/101
2011/0281465 A1 * 11/2011 Hou ..... H01R 12/778 439/607.55
2012/0064769 A1 * 3/2012 Su ..... H01R 13/502 439/607.55
2012/0076462 A1 * 3/2012 Wu ..... G02B 6/3817 385/89
2012/0114288 A1 * 5/2012 Wu ..... G02B 6/3817 385/78
2014/0187094 A1 * 7/2014 Zhao ..... H01R 13/6581 439/626
2014/0220821 A1 * 8/2014 Wu ..... H01R 13/6471 439/607.41
2014/0335729 A1 * 11/2014 Little ..... H01R 24/60 439/607.53
2014/0357124 A1 * 12/2014 Zhao ..... H01R 13/405 439/607.55
2015/0111427 A1 * 4/2015 Wu ..... H01R 13/2457 439/607.01
2016/0233615 A1 * 8/2016 Scholeno ..... H01R 12/712
2018/0145451 A1 5/2018 Wu et al.

* cited by examiner

ELECTRICAL CONNECTOR HAVING A CHAMFERED HOUSING STRUCTURE AND A UNITARY SHIELDING SHELL LATCH ALIGNED WITH THE CHAMFERED HOUSING STRUCTURE

BACKGROUND OF THE INVENTION

1. Field of the Invention

The present invention relates generally to an electrical connector, and more particularly to an electrical connector with a fool-proofing mating frame opening.

2. Description of Related Arts

Virtual reality technology is an important direction of simulation technology, a collection of various technologies such as simulation technology and computer graphics human-machine interface technology multimedia technology sensing technology network technology, and a challenging cross-cutting discipline and research field. Virtual reality technology mainly includes simulation environment, perception, natural skills and sensing equipment. Connectors used in virtual reality technology need to meet the requirements of high speed, multi-channel transmission and small convenience. In the existing connector structure, small connectors meeting high speed transmission requirements, such as Oculink connectors, have upper and lower rows of conductive terminals as shown in the Patent Application Publication No. 2018/0145451 having the same applicant with the instant application. The upper and lower rows of terminals are fixed on the upper and lower sides of a similar square frame to achieve mating with the docking connector. With the diverse needs of connector development in various emerging devices, how to design a simple interface shape to achieve a clear distinction from the existing connector interface has gradually become a problem to be solved.

An improved electrical connector is desired.

SUMMARY OF THE INVENTION

An object of the present invention is to provide an electrical connector with a new mating frame opening.

To achieve the above-mentioned object, an electrical connector comprises: an insulative housing; a plurality of conductive terminals disposed in the insulative housing; and a shield shell covering the insulative housing, wherein the shield shell has a mating frame opening at a front end thereof, the mating frame opening including a top edge, a bottom edge parallel to the top edge, a first side and a second side respectively perpendicular to a left and a right ends of the top edge, a first connecting edge connected between the first side and the bottom edge, and a second connecting edge connected between the second side and the bottom edge, the first connecting edge has a first angle with respect to the bottom edge, the second connecting edge has a second angle with respect to the bottom edge, and the first angle and the second angle are both obtuse angles.

Compared to the prior art, the first connecting edge and the second connecting edge of the mating frame opening are symmetrically disposed at an angle with the bottom edge, respectively, to make a clear difference between the electrical connector of the present invention and the rectangular frame port of existing connector, thereby preventing the user from mis-handling.

DETAILED DESCRIPTION OF THE PREFERRED EMBODIMENT

Referring to FIG. 1-9(B), an electrical connector 100 of the present invention is configured to mate with a pair of connectors for electrical connection. A preferred embodiment of the electrical connector 100 includes an insulative housing 10, a plurality of conductive terminals 20 disposed in the insulative housing 10 and a metal shield shell 30 covering the insulative housing 10.

Figure 1:
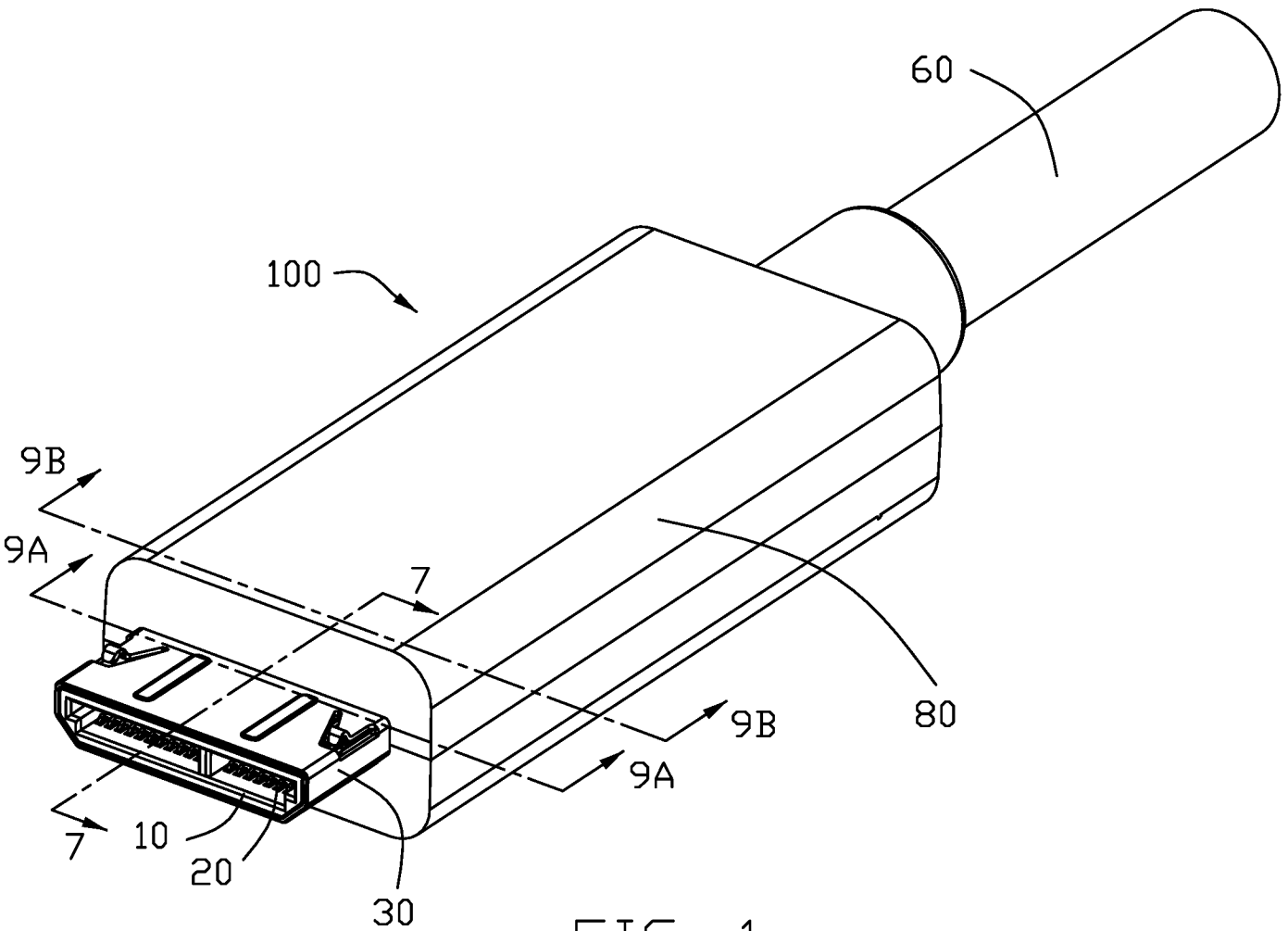
FIG. 1 is a perspective view of an electrical connector in accordance with the present invention.
Figure 2:
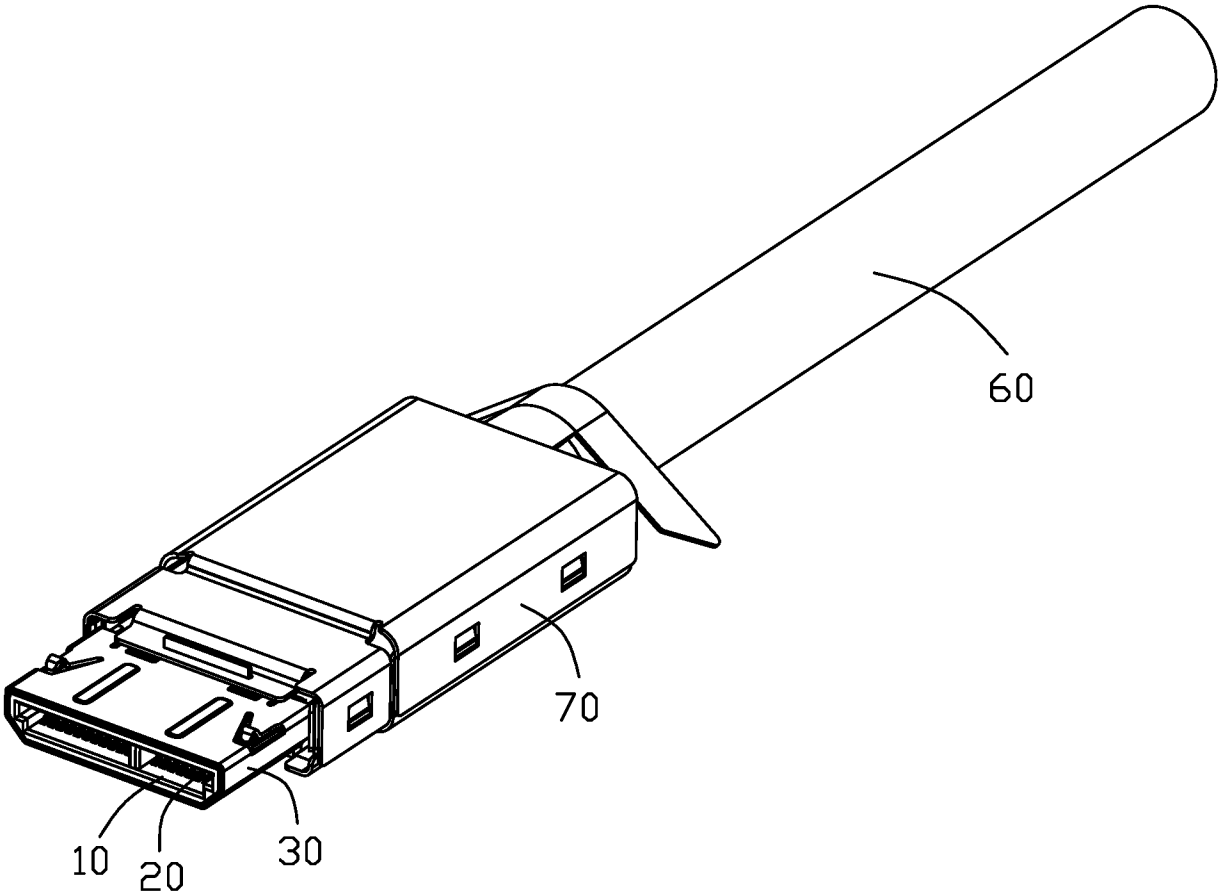
FIG. 2 is an assembly perspective view of the electrical connector without an insulative cover over-coated thereon as shown in FIG. 1.
Figure 3:
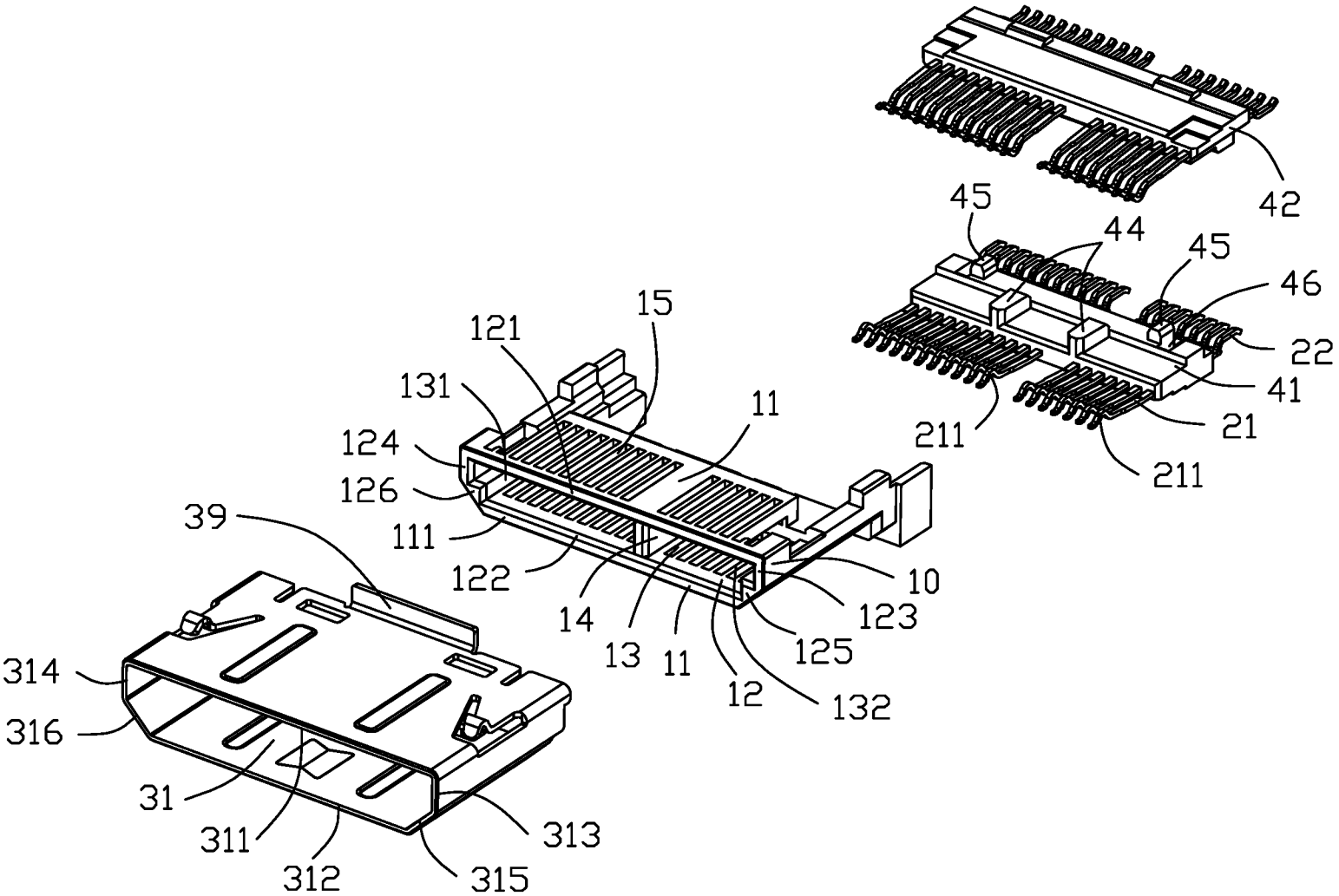
FIG. 3 is an exploded view of the electrical connector with a removed printed circuit board and metal shell as shown in FIG. 2.
Figure 4:
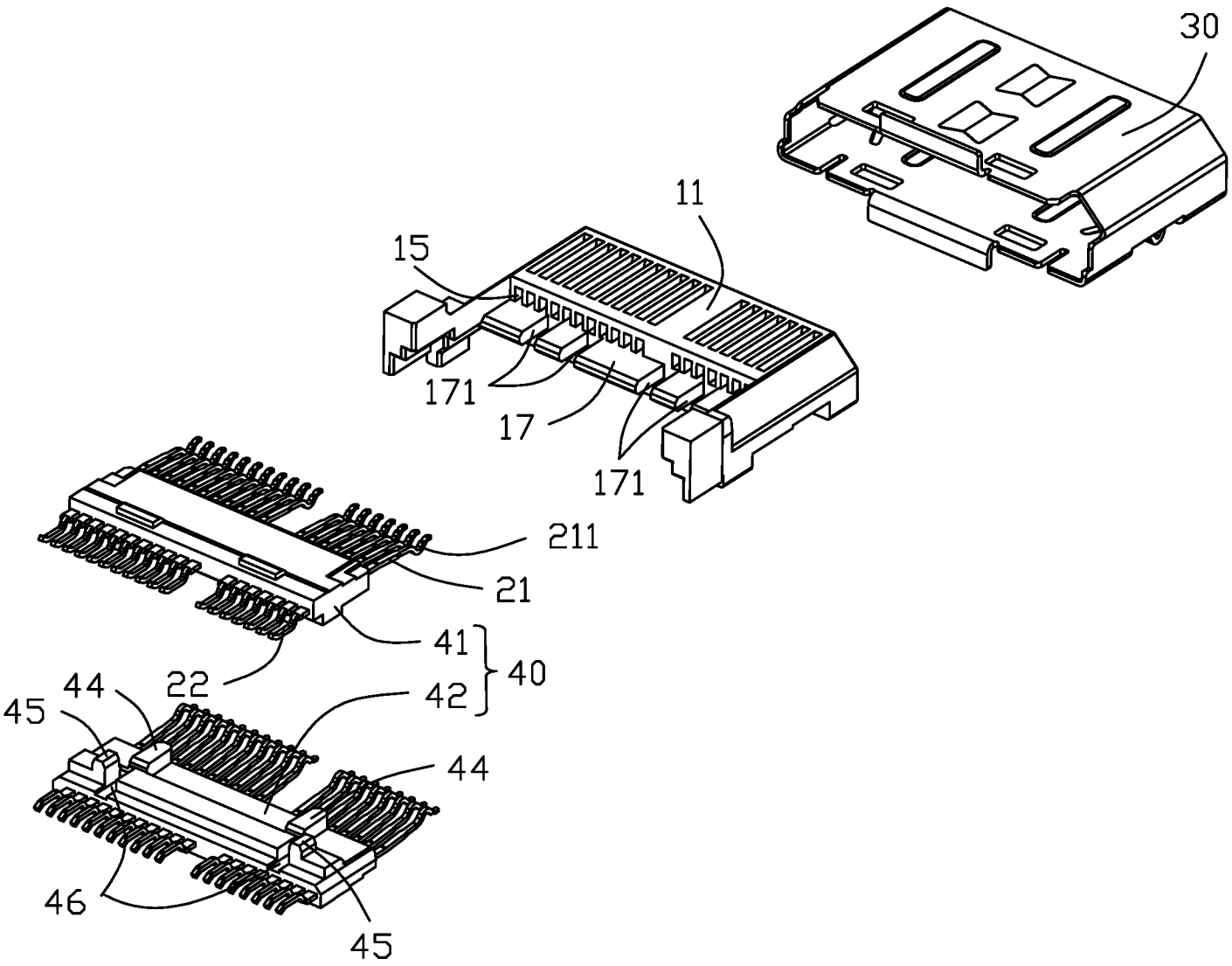
FIG. 4 is another exploded view of the electrical connector as shown in FIG. 3.
Figure 5:
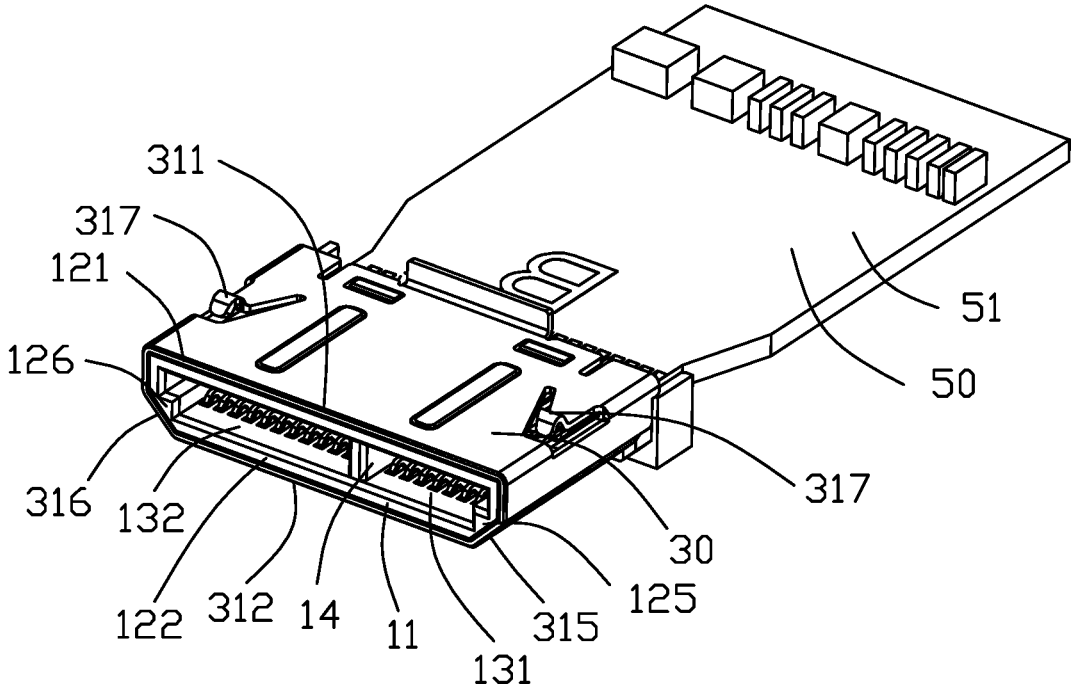
FIG. 5 is an assembly perspective view of the electrical connector with a removed metal shell as shown in FIG. 2.
Figure 6:
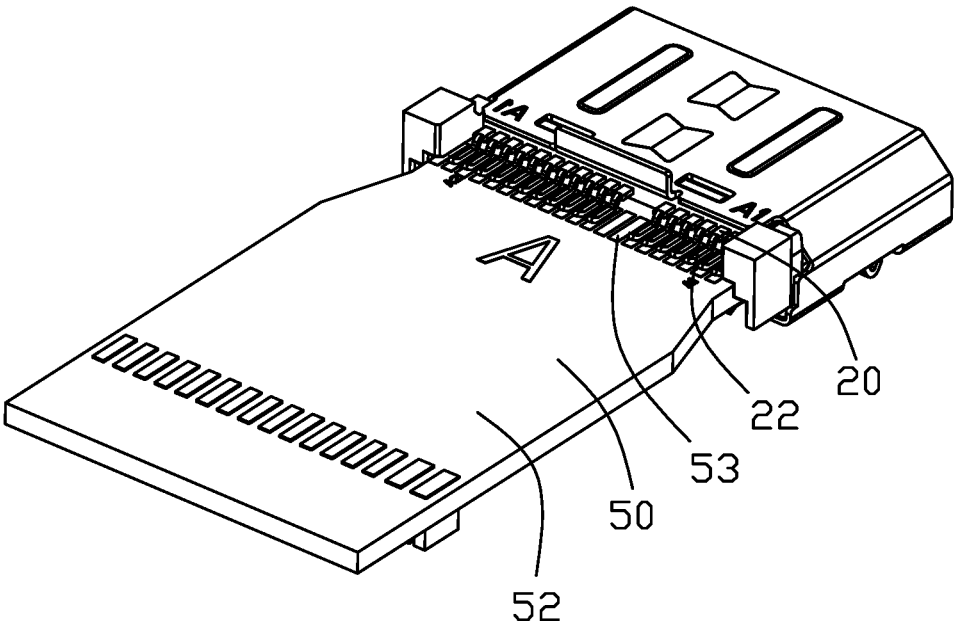
FIG. 6 is another assembly perspective view of the electrical connector as shown in FIG. 5.
Figure 7:
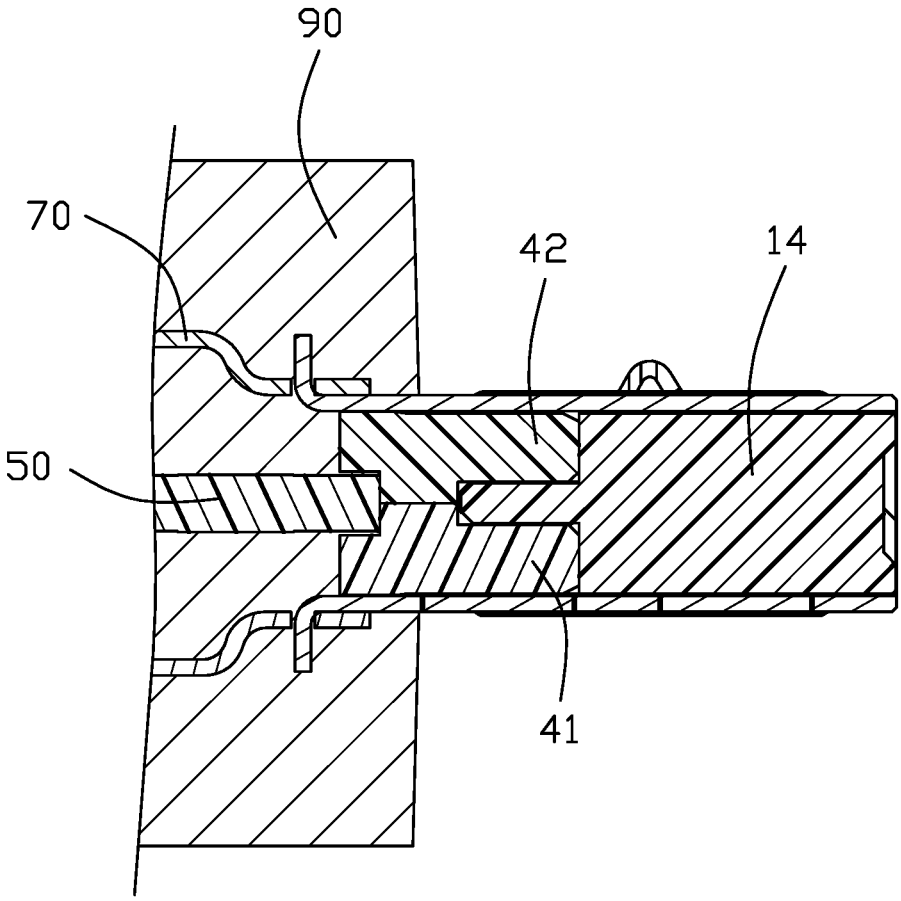
FIG. 7 is a cross-sectional view of the electrical connector taken along line 7-7 as shown in FIG. 1.
Figure 8A:
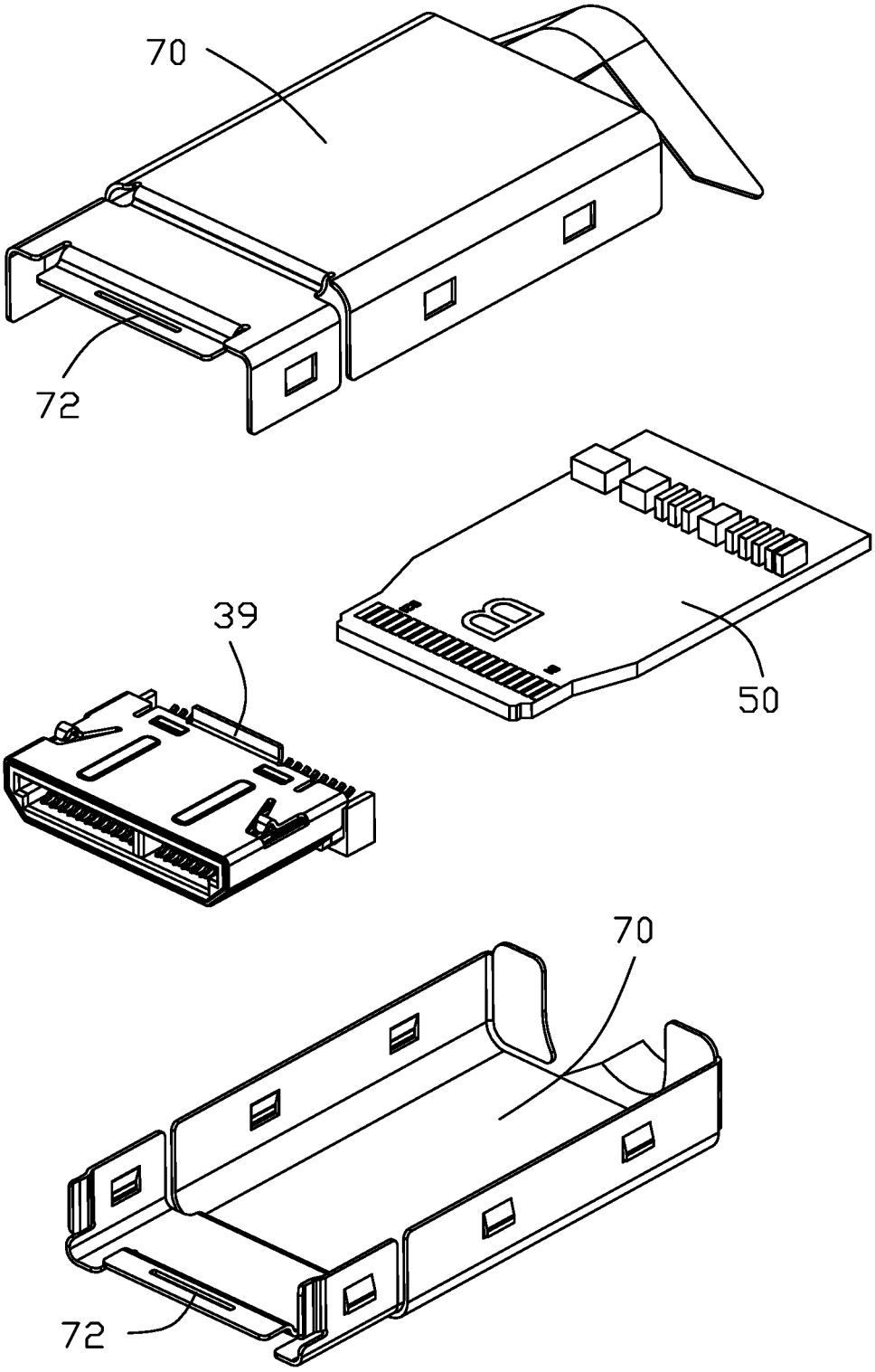
FIG. 8(A) is an exploded perspective view of the electrical connector of FIG. 2.
Figure 8B:
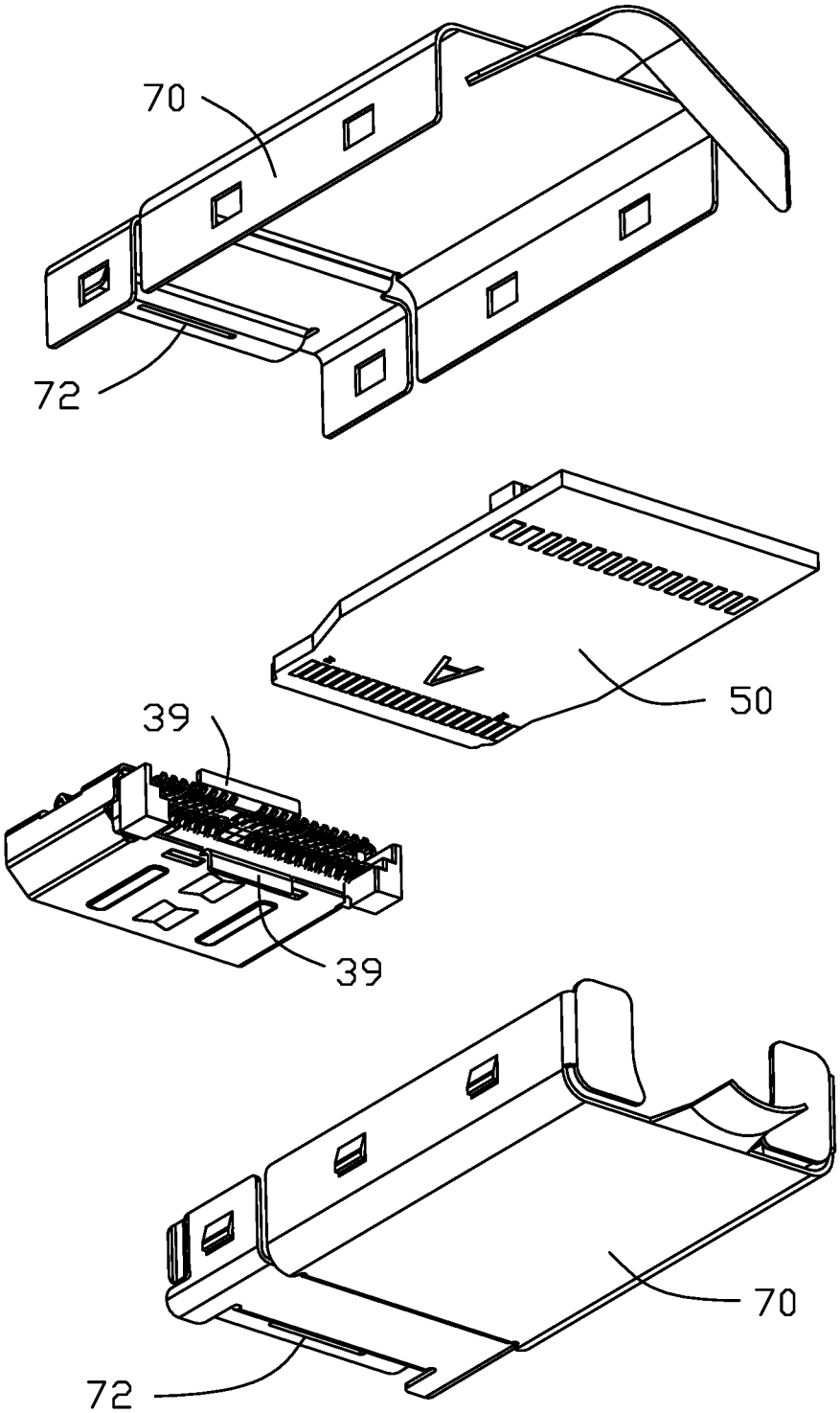
FIG. 8(B) is another exploded perspective view of the electrical connector of FIG. 2.
Figure 9A:
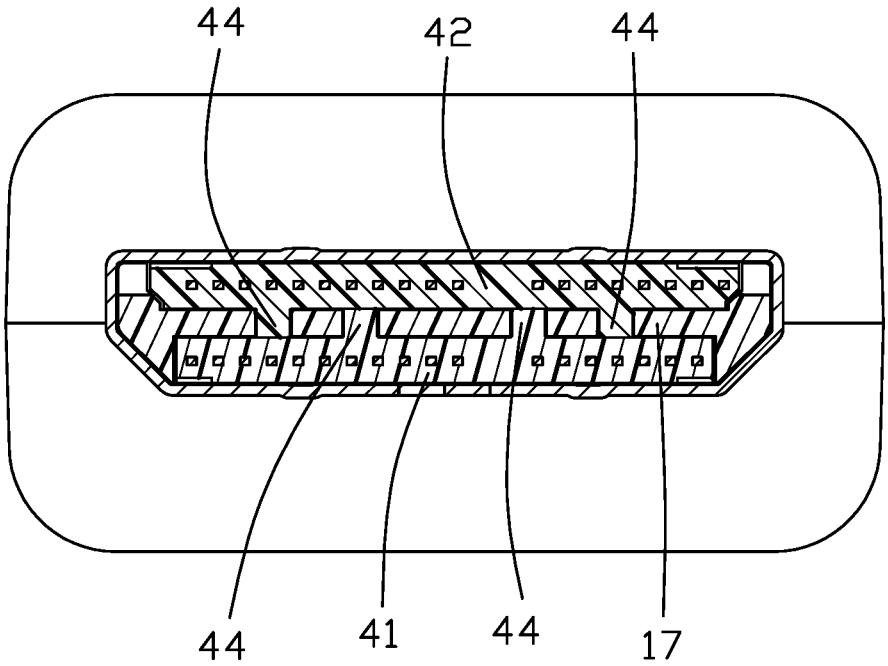
FIG. 9(A) is a cross-sectional view of the electrical connector to show how the upper terminal module and the lower terminal module are engaged with the corresponding slots of the housing.
Figure 9B:
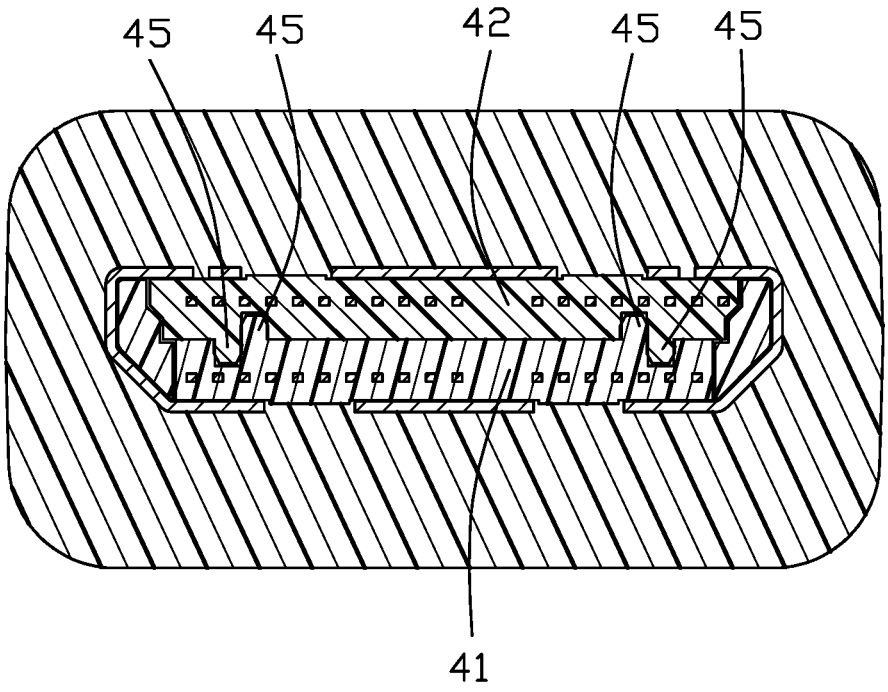
FIG. 9(B) is a cross-sectional view of the electrical connector to show how the upper terminal module and the lower terminal module are engaged with each other.

Referring to FIG. 1-3, the insulative housing 10 includes a body portion 11. The body portion 11 includes a front end face 111, a mating opening 12 disposed on the front end face 111, a mating cavity 13 formed from the mating opening 12 extending perpendicularly into the body portion 11 and a spacer/divider 14 disposed in the mating cavity 13. The mating opening 12 and the mating cavity 13 are for receiving the docking connector. The mating opening 12 includes a top wall 121, a bottom wall 122 parallel and opposite to the top wall 121, a first sidewall 123 and a second sidewall 124 respectively connecting to both ends of the top wall 121 and perpendicular to the top wall 121, a first connecting wall 125 connected with an opposite end between the bottom wall 122 and the first sidewall 123, and a second connecting wall 126 connected with an opposite end between the bottom wall 122 and the second side wall 124. The first connecting wall 125 and the second connecting wall 126 are symmetrically disposed right angle walls. That is, each of the first connecting wall 125 and the second connecting wall 126 includes a horizontal wall (not labeled) and a vertical wall (not labeled) vertically connected to the inner end of the horizontal wall. Opposite, a chamfered structure is formed opposite to each of the first connecting wall 125 and the second connecting wall 126. The width of the top portion of the mating opening 12 and the mating cavity 13 in the lateral direction is greater than the width of the bottom portion thereof in the lateral direction.

The top end of the spacer 14 is connected to the top wall of the mating cavity 13, the bottom end of the spacer 14 is connected to the bottom wall of the mating cavity 13. The spacer 14 divides the mating cavity 13 into a first mating cavity 131 and a second mating cavity 132. The width of each portion of the first mating cavity 131 in the lateral direction is greater than the width of the each portion of the second mating cavity 132 in the lateral direction.

The body portion 11 of the insulative housing 10 has a terminal receiving hole 15 for receiving the conductive terminal 20 forward from the rear end thereof. Each of the terminal receiving holes 15 extends in the front-rear direction. The terminal receiving holes 15 are spaced and evenly distributed on the top side and the bottom side of the mating cavity 13. The terminal receiving holes 15 on the top side of the mating cavity 13 penetrate the top face of the body portion 11 and the top wall of the mating cavity 13 in the vertical direction. The terminal receiving holes 15 on the bottom side of the mating cavity 13 penetrate the bottom face of the body portion 11 and the bottom wall of the mating cavity 13 in the vertical direction. Each of the conductive terminals 20 is received in a corresponding terminal receiving holes.

Each of the conductive terminals or contacts 20 includes a contact portion 21 at the front end, a soldering portion 22 exposed to the rear side of the body portion 11. The contact portion 21 of the conductive terminals 20 received in the top-side terminal receiving holes 15 are bent toward the bottom side to form a contact end 211. The contact portion 21 of the conductive terminals 20 of the terminal receiving hole 15 received in the bottom side is bent toward the top side to form the contact end 211. The contact ends 211 of the contact portions 21 of the conductive terminals 20 are all exposed in the mating cavity 13 to achieve the electrical contact with the docking connector when the docking connector is inserted into the mating cavity 13. The number of conductive terminals 20 exposed within the first mating cavity 131 is less than the number of conductive terminals 20 exposed within the second mating cavity 132. The number of conductive terminals 20 exposed to the top wall of the first mating cavity 131 is more than the number of conductive terminals 20 exposed to the bottom wall of the first mating cavity 131.

The metal shield shell 30 is in the shape of a metal plate and conforms to the shape of the periphery of the insulative housing 10 to tightly cover the insulative housing 10. The front end of the metal shield shelling 30 forms a mating frame opening 31 including a top edge 311, a bottom edge 312 parallel to the top edge 311, a first side 313 and a second side 314 respectively perpendicular to connect the left and right ends of the top edge 311, a first connecting edge 315 connected the corresponding end between the first side 313 and the bottom edge 312, and a second connecting edge 316 connected the corresponding end between the second side 314 and the bottom edge 312. The first connecting edge 315 has a first angle with the bottom edge 312, the second connecting edge 316 has a second angle with the bottom edge 312, the angle between the first angle and the second angle is between the right angle and the flat angle (excluding 90° and 180°), i.e., the obtuse angle. In this embodiment, the angle of the first angle and the second angle are the same and are symmetrically disposed. In this embodiment, the shielding shell 30 unitarily forms a pair of resilient latches 317 which are essentially aligned with the chamfered structures of the housing in the vertical direction.

In the above embodiment of the electrical connector 100 of the present invention, on one hand, the first connecting edge 315 and the second connecting edge 316 of the mating frame opening 31 are symmetrically disposed at an angle with the bottom edge 312, respectively, to make a clear difference between the electrical connector 100 of the present invention and the rectangular frame port of existing connector, thereby preventing the user from mislanding. On the other hand, the spacer 14 disposed in the mating cavity 13 of the electrical connector 100 divides the mating cavity 13 into two parts of different sizes in the lateral direction. Further, even if the user interworks the electrical connector 100 with the connector of the rectangular frame port, there is no way to achieve the insertion fit due to the presence of the spacer 14. On another hand, the mating opening 12 of the electrical connector 100 includes the first connecting wall 125 and the second connecting wall 126 in the shape of a right angle wall. The first connecting wall 125 and the second connecting wall 126 can be independently or cooperate with each other to limit the shape of the portion of the docking connector inserted into the mating cavity 13, thereby achieving further fool-proofing. The electrical connector 100 of the present invention can achieve the foolproof effect against the existing connector to the greatest extent by the cooperation of the above three aspects.

Further, the electrical connector 100 of the present invention further includes an insulator 40 for holding the conductive terminal 20 to form the terminal module (not labeled). The insulator 40 includes a first/lower insulator 41 and a second/upper insulator 42 engaged with the first insulator 41. The first insulator 41 holds the conductive terminal 20, via an insert-molding process, to form a first/lower terminal module on the bottom side of the mating cavity 13. The second insulator 42 holds the conductive terminal 20, via another insert-molding process, to form a first/upper terminal module located on the top side of the mating cavity 13. The first insulator 41 and the second insulator 42 are respectively injection molded to hold the corresponding conductive terminals 20. The contact portions 21 of the conductive terminals 20 are exposed to the front side of the first insulator 41 and the second insulator 42. The soldering portions 22 of the conductive terminals 20 are exposed to the rear side of the first insulator 41 and the second insulator 42. The insulator 40 is assembled and fixed on the rear side of the insulative housing 10, while the contact portion 21 of the conductive terminal 20 is inserted into the corresponding terminal receiving holes 15 and exposed to the mating cavity 13. Each of the first insulator 41 and the second insulator 42 has the front protrusions 45 to be received within the corresponding slots 171 formed in the platform 17 of the body portion 11 of the housing 10 so as to fasten each terminal module to the housing 10, and further has the rear protrusions 45 received within the corresponding recesses 46 of the other for securing the upper and lower terminal modules together. In this embodiment, the rear protrusion 45 of the first insulator 41 abuts against the corresponding rear protrusion 45 of the second insulator 42 in the transverse direction.

Further, the electrical connector 100 of the present invention also includes a printed circuit board 50 fixedly assembled to the rear end of the insulative housing 10. The printed circuit board 50 includes a top face 51 and a bottom face 52 opposite the top face 51. The printed circuit board 50 is provided with a plurality of conductive plates 53 spaced apart from the top face 51 and the bottom face 52 of the front end thereof. The soldering portions 22 exposed to the conductive terminals 20 of the terminal module are correspondingly soldered to the corresponding conductive plates 53 to electrically connect the conductive terminals 20 to the printed circuit board 50.

Figure 10A:
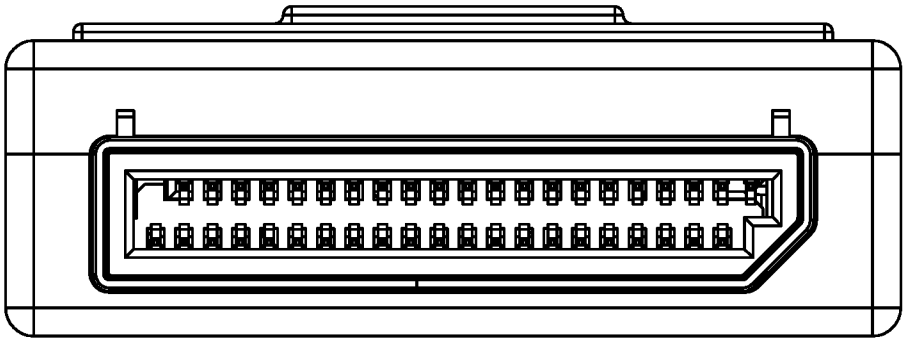
FIG. 10(A) is a front view of the electrical connector of the copending application with the publication number 2018/0145451.
Figure 10B:
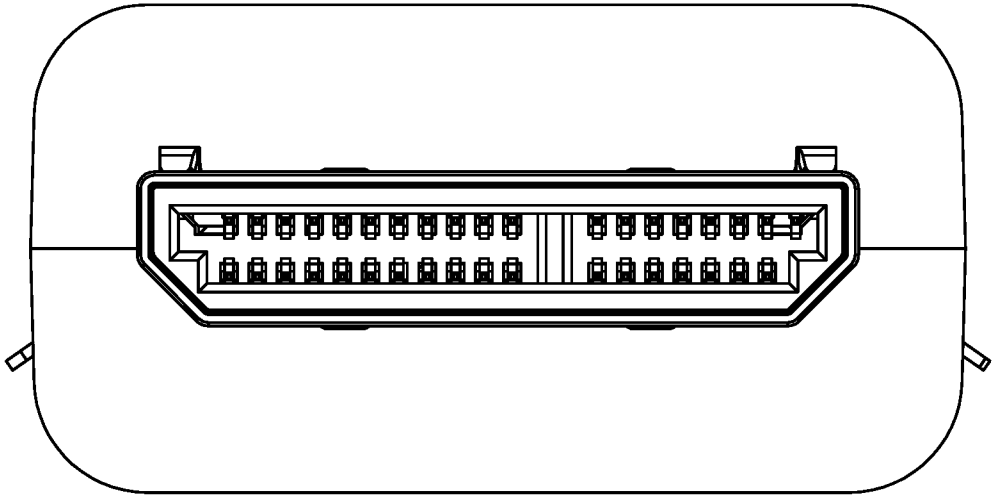
FIG. 10(B) is a front view of the electrical connector of FIG. 1.

Further, the electrical connector 100 of the present invention also includes a cable 60 electrically connected to the printed circuit board 50, a metal shell 70 covering the front end of the terminal module, the printed circuit board 50 and the cable 60, and an insulative cover 80 coated on the metal shell 70. The metal shell 70 forms a slit to receive a corresponding flared section of the shielding shell 30. As shown in FIG. 10(A), the interface configuration of the existing connector is asymmetrically arranged with regard to a vertical centerline thereof while the number of the upper contacts is equal to that of the lower contacts even if the upper contacts are offset from the lower contacts with one pitch in the transverse direction. Differently, as shown in FIG. 10(B), the interface configuration of the instant invention is symmetrically arranged with regard to the vertical centerline while the upper contacts are more than the lower contacts in amount and the divider 14 is formed in the mating cavity 13 to from two groups of the contacts. Understandably, the instant invention and the existing connector may somewhat share the molds during manufacturing for saving costs.

What is claimed is:

1. An electrical connector comprising:

an insulative housing including a top wall and a bottom wall opposite to each other in a vertical direction, and a pair of side walls opposite to each other in a transverse direction perpendicular to the vertical direction, the top wall, the bottom wall and the pair of side walls commonly forming a mating cavity forwardly communicating, via a mating opening, with an exterior along a front-to-back direction perpendicular to both the vertical direction and the transverse direction, an upper portion of the mating cavity being larger than a lower portion thereof in the transverse direction, at least one chamfered structure formed between the bottom wall and at least one sidewall;

a metallic shielding shell enclosing the housing; and an upper terminal module and a lower terminal module commonly forwardly assembled to the housing along said front-to-back direction, the upper terminal module including a plurality of upper contacts integrally formed with an upper insulator, and the lower terminal module including a plurality of lower contacts integrally formed with a lower insulator; wherein each of said upper contacts and said lower contacts includes a contact portion extending into the mating cavity, the upper insulator has a front protrusion received within a corresponding slot in the housing, and a rear protrusion received within a corresponding recess in the lower insulator, and the lower insulator has a front protrusion received within a corresponding slot in the housing and a rear protrusion received within a recess in the upper insulator;

a pair of chamfered structures are formed between the bottom wall and the corresponding sidewalls, respectively; and the metallic shielding shell is formed as a single unitary piece of material to unitarily form a pair of resilient latches aligned with the corresponding chamfered structures in the vertical direction.

2. The electrical connector as claimed in claim 1, wherein the rear protrusion of the upper insulator abuts against the rear protrusion of the lower insulator in the transverse direction.

3. The electrical connector as claimed in claim 1, wherein the upper contacts are more than the lower contacts in amount.

4. The electrical connector as claimed in claim 1, wherein a divider is formed in the mating cavity to form different sized small mating cavities.

5. The electrical connector as claimed in claim 1, further including a metal shell attached to the shielding shell, wherein the metal shell forms a slit to receive a flared section of the metallic shielding shell.

6. An electrical connector comprising:

an insulative housing including a top wall and a bottom wall opposite to each other in a vertical direction, and a pair of side walls opposite to each other in a transverse direction perpendicular to the vertical direction, the top wall, the bottom wall and the pair of side walls commonly forming a mating cavity forwardly communicating, via a mating opening, with an exterior along a front-to-back direction perpendicular to both the vertical direction and the transverse direction, an upper portion of the mating cavity being larger than a lower portion thereof in the transverse direction, at least one chamfered structure formed between the bottom wall and at least one sidewall; and a metallic shielding shell enclosing the housing and including:

a mating frame opening at a front end thereof, the mating frame opening including a top edge, a bottom edge parallel to the top edge, a first side and a second side respectively perpendicular to a left end and a right end of the top edge, a first connecting edge connected between the first side and the bottom edge, and a second connecting edge connected between the second side and the bottom edge, at least one of the first connecting edge and the second connecting edge extends at an obtuse angle to comply with the chamfered structure; wherein said shielding shell is formed as a single unitary piece of material to further include a resilient latch unitarily extending outward and aligned with the chamfered structure in the vertical direction.

7. The electrical connector as claimed in claim 6, wherein the housing forms a pair of chamfered structures, and both the first connecting edge and the second connecting edges extend at the obtuse angles, and the shielding shell unitarily forms a pair of resilient latches spaced from each other in the transverse direction while aligned with the corresponding chamfered structures in the vertical direction.

8. The electrical connector as claimed in claim 7, wherein opposite upper and lower rows of contacts are retained in the housing, and the contacts in the upper row are more than those in the lower row in amount.

9. The electrical connector as claimed in claim 8, wherein the mating frame opening is symmetric with regard to a vertical centerline thereof in the transverse direction.

* * * * *